United States Patent [19]

Matthew et al.

[11] Patent Number: 4,529,137

[45] Date of Patent: Jul. 16, 1985

[54] MULTIPLE DISK REFINER FOR LOW CONSISTENCY REFINING OF MECHANICAL PULP

[75] Inventors: John B. Matthew; David H. Robinson, both of Pittsfield, Mass.

[73] Assignee: Beloit Corporation, Beloit, Wis.

[21] Appl. No.: 486,005

[22] Filed: Apr. 18, 1983

[51] Int. Cl.[3] ..... B02C 7/12

[52] U.S. Cl. ..... 241/163; 241/261.2; 241/285 R

[58] Field of Search ..... 241/296, 297, 298, 259.1, 241/259.2, 161, 162, 163, 261.2, 261.3, 250, 251, 253, 261, 28, 285 R, 285 A, 285 B

[56] References Cited

U.S. PATENT DOCUMENTS

| | | | |
|---|---|---|---|
| 2,718,178 | 9/1955 | Wandel | 92/20 |
| 3,371,873 | 3/1968 | Thomas | 241/163 |
| 4,167,250 | 9/1979 | McMillin et al. | 241/251 |

FOREIGN PATENT DOCUMENTS

| | | | |
|---|---|---|---|
| 527395 | 7/1956 | Canada | 241/163 |
| 1145532 | 10/1957 | France | 241/163 |
| 26688 | of 1911 | United Kingdom | 241/163 |

*Primary Examiner*—Mark Rosenbaum

*Attorney, Agent, or Firm*—Hill, Van Santen, Steadman & Simpson

[57] ABSTRACT

A refiner comprising a housing having a refining chamber providing a flow path for particulate material to be refined while travelling between an upstream inlet and a downstream outlet. A refining assembly in the chamber has a series of relatively rotatably cooperative axially confronting annular refining surfaces located on partially internested refining disks and defining radially extending refining zones therebetween and with radially opposite ends of the zones closed. Passages defined by and between the internested portions of the disks connect the adjacent refining zones in a manner to cause the particulate material such as paper making stock to pass successively between the radially outer ends of the zones and the radially inner ends of the zones.

18 Claims, 4 Drawing Figures

MULTIPLE DISK REFINER FOR LOW CONSISTENCY REFINING OF MECHANICAL PULP

BACKGROUND OF THE INVENTION

1. Field of the Invention

This invention relates to the art of refining particulate material and is more particularly concerned with refining paper making pulp stock.

2. Description of Prior Art

Mechanical wood pulp is initially reduced to a fibrous form by grinding logs on a rotating stone or by grinding chips in a disk mill. Following this initial fiberization, any further comminution of the mechanical wood fibers is accomplished in a disk mill, generally operated in the vapor phase using either pressurized or non-pressurized conditions.

The vapor phase milling or refining system suffers from two major drawbacks, namely, high energy consumption, and difficult system control. Energy application in a vapor phase system is quite inefficient and, thus, requires high energy consumption to achieve necessary freeness reduction in pulping quality development. The heterogenous nature of the milling process, coupled with the constantly changing condition of the refiner plates, means that energy application must be constantly altered to maintain a uniform freeness or pulp quality. In a typical vapor phase system, the inherent latency induced into the pulp must be removed prior to drainage measurements. This causes a lag time of, for example, 30 to 60 minutes in system feedback control. Thus it is very difficult to maintain a highly uniform product.

Low consistency refining as an alternative to vapor-phase refining would be much preferred. However, heretofore low consistency refining has proven ineffective because classical low consistency refining techniques typically used for chemical pulp fibers, were used for refining mechanical pulps. The resulting pulps exhibited severe fiber shortening with little or no strength development from increased bonding. The stiff, brittle nature of the mechanical pulp fibers requires that a low refining intensity be applied to the pulp to prevent fiber shortening. At the same time, a substantial amount of energy, by low consistency refining standards, must be applied to the fiber to generate the very high specific surface required in mechanical pulps. Existing refiners do not have the capability of providing low intensity and high specific energy at commercially acceptable throughputs.

Refining intensity is defined as horsepower per refiner bar inch crossings per minute (HP/ICPM) and specific energy is defined as horsepower per ton per day (HP/T/D). Therefore, to provide low refining intensities and high specific energy at commercial throughputs, an extremely large number of ICPM's are required within one machine. To provide this capability in a conventional single or double disk low consistency refiner would require prohibitively large refining disk diameters or rotational speeds.

An additional concern, in low consistency refining, is the fact that the rotating disks act as a hydraulic pump, resulting in large energy requirements for the refiner during the circulating or no-load condition. This circulating load increases proportionally with the cube of the speed, resulting in very high no-load energies at high RPM. Therefore, it is critical to keep the circulating energy as low as possible in proportion to the net refining energy.

By way of example, attention is directed to the following prior U.S. patents representing refiners which, however, do not attain the desired results for low consistency refining of mechanical pulp:

U.S. Pat. No. 3,371,873 discloses a single rotary disk arrangement and which inherently lacks the desired low consistency refining capability due to the ineffeciencies mentioned hereinabove.

U.S. Pat. No. 2,718,178 discloses a multi-disk arrangement wherein the disks are widely axially spaced in an arrangement which requires unacceptably large space for minimum refining results.

U.S. Pat. No. 4,167,250 discloses a multi-disk arangement requiring an unacceptably complex driving system.

SUMMARY OF THE INVENTION

An important object of the present invention is to provide a new and improved multiple disk refiner and method for low consistency refining of mechanical pulp and which will overcome the disadvantages, drawbacks, inefficiencies, limitations, shortcomings and problems inherent in prior arrangements and methods.

To this end, the present invention affords in a refiner comprising a housing having a refining chamber providing a flow path for particulate material to be refined while travelling between an upstream inlet and a downstream outlet, the improvement comprising a refining assembly located across the flow path and having a series of relatively rotatably cooperative axially confronting annular refining surfaces defining radially extending refining zones therebetween, and with radially opposite ends of the zones closed; and means for causing the particulate material to pass successively between the radially outer ends and the radially inner ends of the zones in continuous refining flow from an upstream end to a downstream end of the refining assembly.

BRIEF DESCRIPTION OF THE DRAWINGS

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure, and in which.

DETAILED DESCRIPTION

Figures 1, 4:
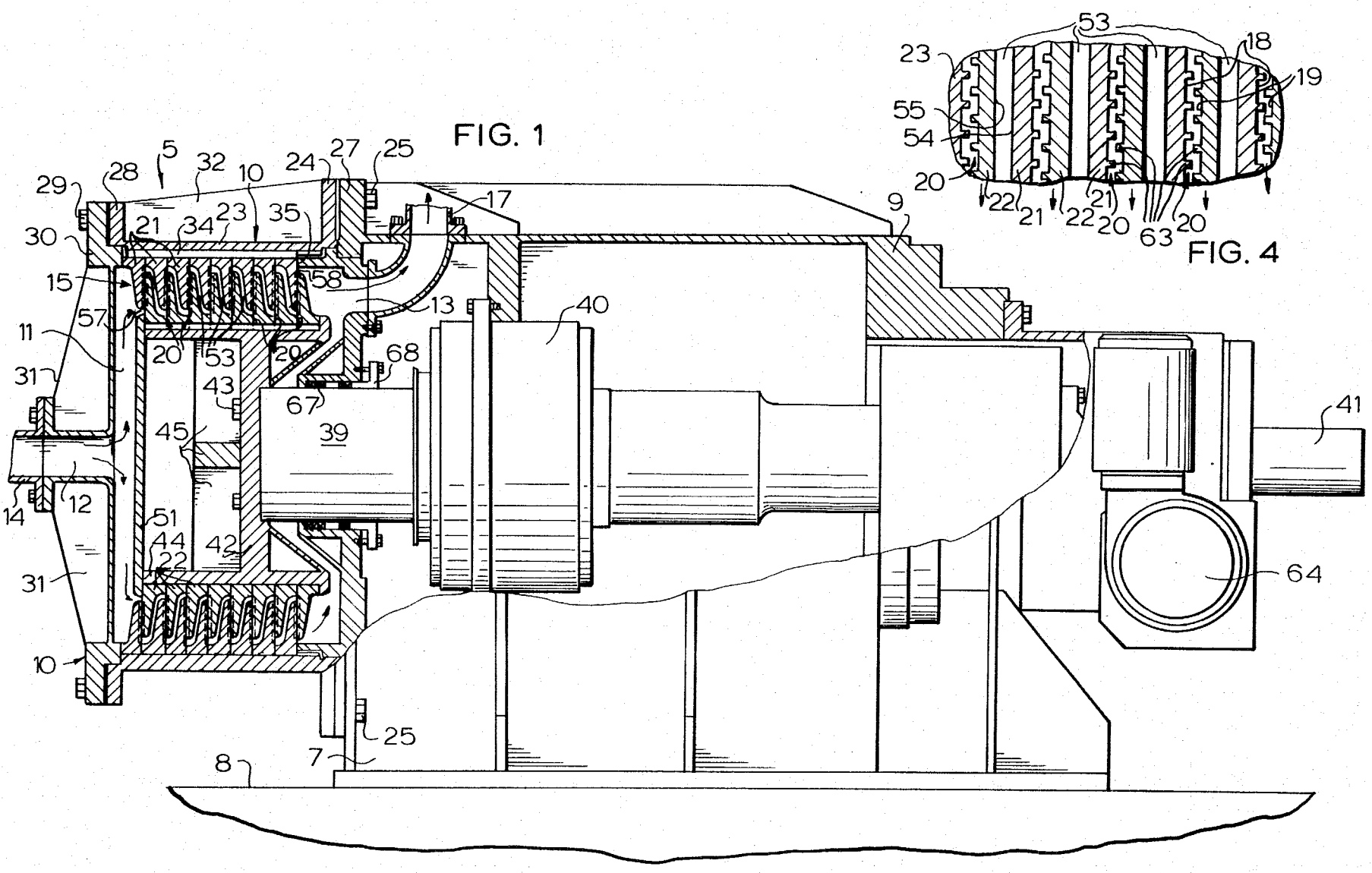
FIG. 1 is a side elevational and partially longitudinal sectional view showing a refiner embodying the present invention.
FIG. 4 is an enlarged fragmentary sectional detail view taken substantially along the line IV—IV of FIG. 2.

A refiner 5 embodying the present invention, includes a base 7 mounted on a suitable foundation 8 and supporting a refiner frame 9. At one end of the frame 9 is carried a housing 10 which has therein a refining chamber 11 providing a flow path for particulate material to be refined while travelling between an upstream inlet 12 and a downstream outlet 13. The material to be refined, and in particular low consistency paper pulp or stock, is pumped by suitable pumping means (not shown) through a pipe 14 connected with the inlet 12. A refining assembly 15 is located in the chamber 11 across the flow path between the inlet 12 and the outlet 13. Refined material is discharged through the outlet 13 to a pipe 17 which conveys the refined material to a point of further treatment or to the headbox of a paper making machine.

Paper making pulp stock in the form of a slurry of a consistency of from 1% to 8% is adapted to be efficiently refined by the refining assembly 15, comprising a unique, compact arrangement of a series of relatively rotatably cooperative axially confronting annular refining surfaces 18 and 19 which define radially extending refining zones 20 therebetween. In a preferred arrangement, the refining surfaces 18 and 19 comprise axially oppositely facing surfaces on annular generally internested refining disks 21 and 22 which, in effect, are in a longitudinally stacked assembly or pack.

In the refining process, the disks 21 and 22 must be caused to rotate relatively. Either or both of the sets of disks 21 and 22 may be rotatably mounted. In a simple arrangement, as shown, the disks 21 may be stator disks, fixed at radially outer edges thereof to an annular longitudinally elongate wall member 23 forming part of the refining chamber housing 10. At its axially inner end, the housing member 23 has means comprising a radially outwardly extending annular flange 24 secured as by means of screws 25 to a radially outwardly extending annular frame portion 27. At its axially outer end, the member 23 has a radially outwardly extending annular attachment flange 28 which has secured thereto as by means of screws 29 an enclosure or cover 30 for the chamber 11. Desirably the inlet 12 is formed in the cover 30. For maximum pressure resistance strength in as light weight a construction as practicable, the cover 30 is provided with radially extending reinforcing ribs 31, and the longitudinal housing member 23 is provided with longitudinally extending circumferentially spaced, radially projecting reinforcing ribs 32.

At their radially outer edges, the stator refining rings 21 are maintained concentric by engagement with a cylindrical inner surface 33 provided by the housing member 23. Means comprising a longitudinal key 34 retains the disks 21 against torsional displacement relative to one another and to the surface 33. At their radially outer margins, the disks 21 are held in preferably snug face-to-face engagement in their stack set by means comprising an annular axially outwardly facing shoulder 35 adjacent to the axially inner end of the housing member 23 and against which shoulder the axially intermost of the disks 21 thrusts under axially inward thrusting bias effected by means of an annular thrusting shoulder 37 on the cover 30. By action of the screws 29 on the cover 30, the shoulder 37 is drawn up firmly against the axially outermost of the disks 21 and which thereby transmits the disk compacting thrust to all of the other of the disks 21 in the stack.

On the other hand, the refining disks 22 are mounted corotatably on a rotor 38 which is rotatably mounted on a shaft 39 supported by bearing means 40 mounted to the housing 9. Driving of the shaft 39 is adapted to be effected in any suitable means such as by an electrical motor (not shown) coupled to a shaft terminal 41 at the axially opposite end of the shaft from the rotor 38.

In a desirable construction, the rotor 38 comprises a circular axially facing body plate 42 which is secured concentrically to the contiguous end of the shaft 39 as by means of screws 43. Carried coaxially by the perimeter of the body plate 42 is means in the form of a rigidly fixedly attached axially elongate cylindrical disk-mounting member 44. For rigidity with as nearly as practicable minimum material mass, the rotor body plate 42 and the mounting cylinder 44 are of as thin a section as suitable for the purpose and reinforced by radially extending reinforcing ribs 45 attached to the axially outer face of the body plate 42 and to the radially inner perimeter of the cylinder 44.

Figure 3:
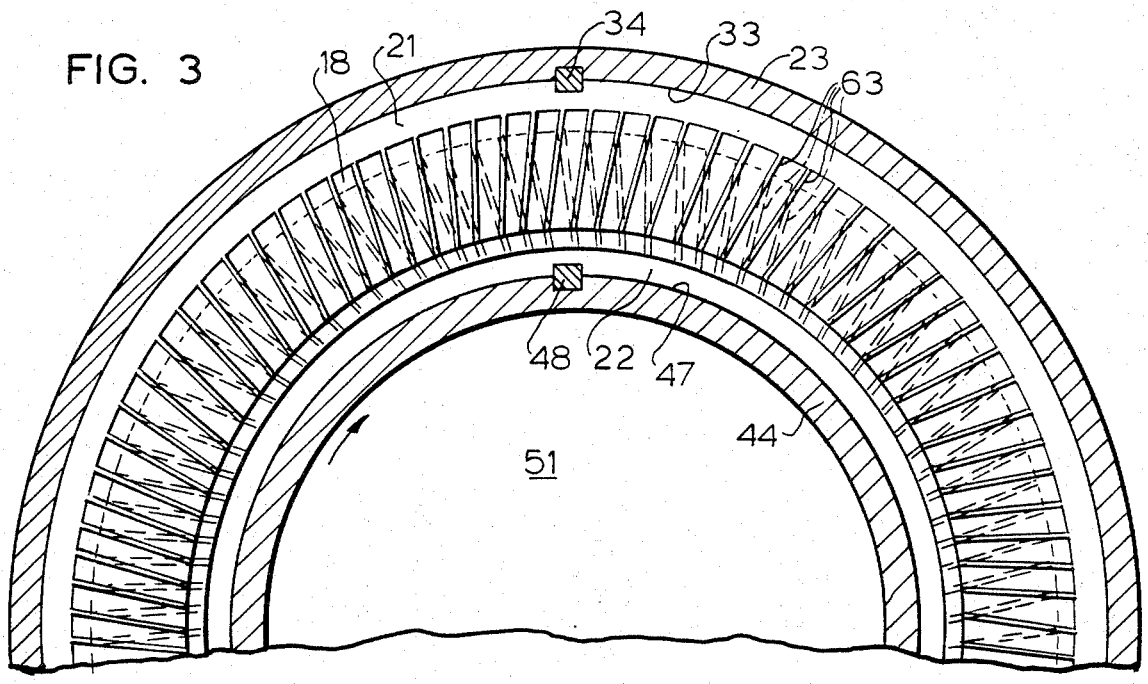
FIG. 3 is a sectional elevational detail view taken substantially along the line III—III of FIG. 2.

On its radially outer perimeter, the disk mounting cylinder 44 has a cylindrical surface 47 (FIG. 3) with which the radially inner edges of the refining disks 22 are concentrically engaged. Means for retaining the disks 22 corotative with the rotor 38, and particularly the mounting cylinder 44, comprises a key 48.

Figure 2:
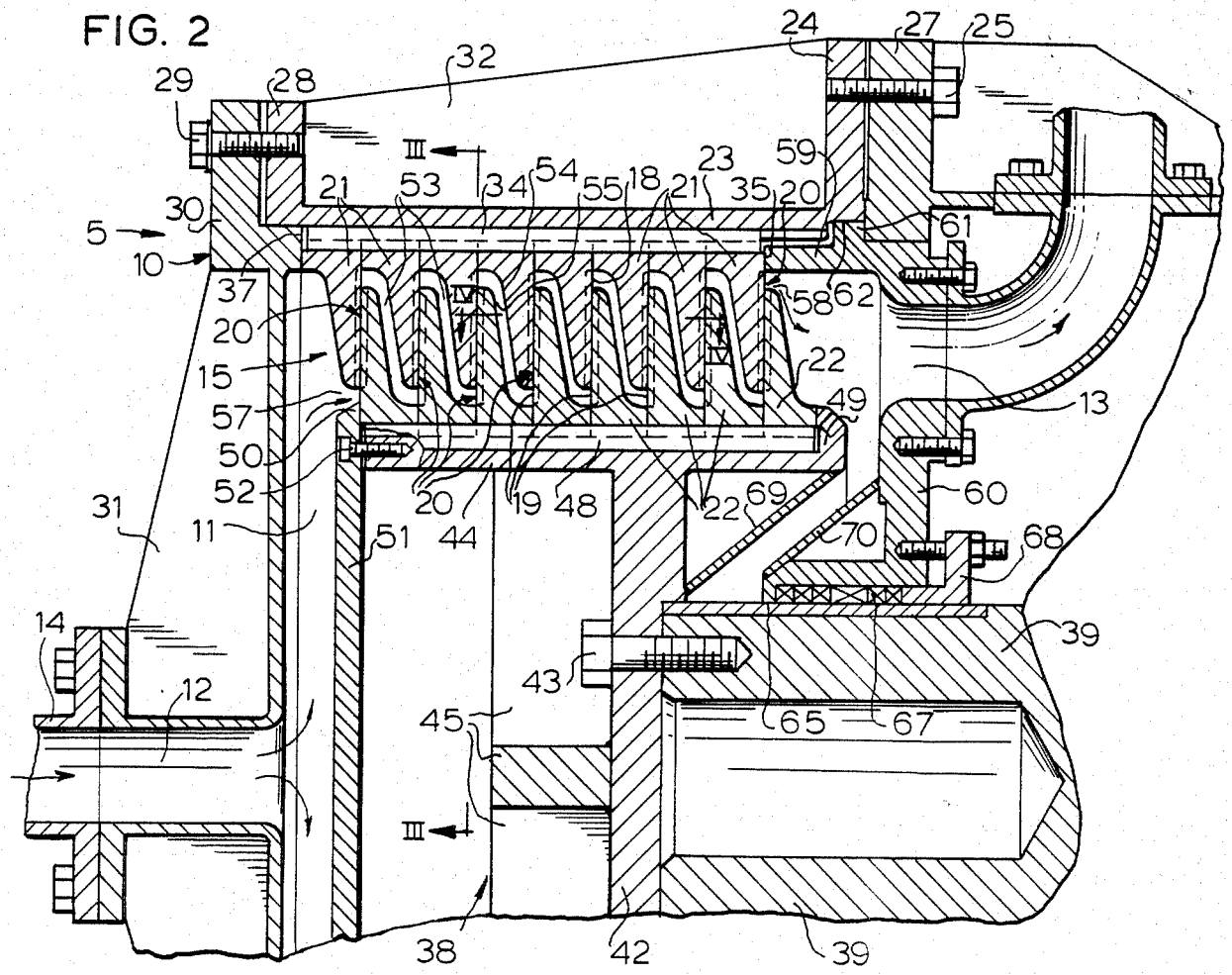
FIG. 2 is a substantially enlarged fragmentary detail view showing the refining assembly of FIG. 1 in better detail.

A firmly stacked retention of the refining disks 22 on the mounting cylinder 44 is effected by thrusting the radially inner margin of the axially innermost of the disks 22 against an annular radially outwardly projecting shoulder 49 at the axially inner end of the mounting cylinder 44. Firm stack packing, axially inward thrusting of the disks 22 is effected by means of an annular thrust shoulder 50 provided on the outer margin of a closure disk plate 51 which is secured concentrically on the axially outer end of the rotor 38 as by means of take up screws 52 threadedly engaged in the axially outer end of the cylinder 44. As best viewed in FIGS. 1 and 2, the closure plate 51 cooperates with the adjacent inner face of the cover 30 to confine the area of the refining chamber 11 between the plate 51 and the cover 30 to a relatively narrow intake flow gap leading incoming material to be refined from the inlet 12 toward the refining assembly 15.

According to the present invention, optimum refining results are achieved per unit of energy input by seriatim refining action in the refining zones 20 from one end of the refining assembly 15 to the other end of the refining assembly 15. To this end, the radially opposite ends of the refining zones 20 are closed, and the particulate material to be refined is caused to pass successively between the radially opposite ends of the adjacent zones 20, and in one desirable arrangement, as shown, from the radially outer ends of upstream zones to the radially inner ends of the next adjacent downstream zones in the flow pattern from one end to the opposite end of the refining assembly 15. It may be noted that the direction of flow through the assembly 15 may be opposite to that specifically shown, if the inlet 12 becomes the outlet and the outlet 13 becomes the inlet.

Closure of the radially opposite ends of the several refining zones 20 is effected by having the anchored margins of the two cooperating sets of disks 21 and 22 in firm abutment, and the refining surfaces 18 and 19 extending throughout an annular area on the respective disks extending from the free edges of the disks to the annular margins but substantially short of the respective mounting edges of the disks. Therefore, there is provided by the abutting faces of the anchored disk margins effective closure means for the radially opposite ends of the refining zones 20.

Communication of the refining zones 20 is effected through generally oblique annular transfer passages 53 which, starting at the upstream end of the refining assembly 15 connect the radially outer end of one refining zone 20 with the radially inner end of the next adjacent downstream zone 20. In a desirable construction, the transfer passages 53 are provided by and between complementary spaced surfaces 54 and 55 on the backside, confronting surfaces of the disks 21 and 22, respectively. In a desirable form, the complementary passage surfaces 54 and 55 are of generally planar oblique width throughout their major extent and then with arcuate edges running out at the opposite ends of the surfaces. Thus, the surfaces 54 on the disks 21 all extend from the radially inner sides of the respective margins of the disks 21 to the tip ends of the disks 21 and running out at the radially inner ends of the refining faces or surfaces 18. Cooperatively, the passage surfaces 55 on the disks 22 extend generally radially inwardly from the tips of the disks 22 to the radially outer sides of the radially inner margins of the disks 22. Through this arrangement, each of the passages 53 has a radially outer, upstream entrance which is aligned with the radially outer, downstream end of one of the refining zones 20, while the opposite, radially inner downstream end of the passage is aligned with the radially inner, upstream end of one of the refining zones 20.

At the upstream end of rhe refining assembly 15, a narrow annular entrance port 57 from the upstream end of the chamber 11 is defined between the perimeter of the closure plate 51 and the radially inner edge of the adjacent refining disk 21. Thereby the material to be refined is guided to the radially inner end of the first in the series of refining zones 20. On leaving the radially outer end of this first refining zone 20, the material flows through the communicating passage 53 to the radially inner end of the next adjacent downstream refining zone 20. As the refining process continues this supertive flow pattern is repeated throughout the series of connected refining zones 20 and passages 53, to the end of the refining assembly 15, where the refined material leaves the radially outer end of the final refining zone 20 and passes by way of an annular exit port 58 into the downstream subchamber portion of the refining chamber 11 and then passes on through the outlet 13.

In a preferred arrangement, the annular exit port 58 is defined in alignment with the discharge end of the associated refining zone 20 by means of the radially outer edge of the axially innermost of the refining disks 22 and an annular tubular flange 59 telescopically engaged within the axially inner end portion of the housing member 23. In a practical arrangement, the flange 59 is part of an axially inner closure member 60 for the refining chamber 11. It is this member 60 that has the outlet 13. For securing the closure member 60 accurately in place, an annular radially outwardly projecting rib 61 on the flange 59 is received in an annular rabbet groove 62 in the adjacent end of the member 23 and confined by the adjacent portion of the frame element 27.

It will be understood, of course, that the material being refined is under dynamic pump pressure. In addition, at least some flow-through impulsion assistance may be afforded by the relatively rotating refining disks 21 and 22, at least to the extent that the flow through the refining assembly 15 will be free from back pressure and thus free from energy consuming loading of the rotor 38. Thus maximum product return for energy input is attained. This is important when it is considered that for maximum efficiency in refining low consistency pulp stock, a desirable peripheral disk speed for the rotor-mounted disks 22 may be on the order of 3,000 to 5,000 feet per minute.

As is customary, the refining surfaces 18 and 19 are provided with generally radially extending refining bars 63, which may extend in straight radial direction, but are preferably relatively angled or biased in respectively opposite directions on the confronting refining surfaces. To this end, the refining bars 63 on the refining surfaces 18 desirably are biased in the direction of rotation of the rotor 38, that is clockwise as viewed in FIG. 3, while the refining bars 63 on the refining surfaces 19 on the rotor disks 22 are angled or biased in the opposite or counterclockwise direction as viewed in FIG. 3. Not only does this afford a smooth refining action by and between the bars, but assures that all of the particulate material to be refined will be acted upon by the relatively rotating refiner surfaces in particular the bars 63, but will also add a component of flow-through propultion to the material being refined.

In a preferred arrangement, in a refining assembly 15 where the refining surface areas 18 of the disks 21 extend to an outside diameter of 41.5 inches and the refining surface areas 19 on the disks 22 extend to an outside diameter of 40 inches, the refining bars 63 may be 1/16 inch wide and 1/16 inch high, and with a 3/16 inch space between each pair of bars. With such an arrangement the circulating energy is reduced significantly. In addition, by use of the multiple pairs of refining disks, an optimum, relation of disk pairs to refining speed can be selected to optimize capital and operating costs.

In order to attain the maximum yield for the particular particulate material being refined, refining disks clearances should be adjusted as determined for the intended result. For this purpose, the rotor 38 is adapted to be axially adjustable as permitted by the spacing providing the oblique annular passages 53 between the respective pairs of the disks 21 and 22. The rotor shaft 39 is adapted to be axially shiftably adjustable in the bearing 40, appropriate adjustment gearing including a gear motor 64 being selectively operable to attain the desire axial adjustment. For such axial adjustment, the shaft 39 extends into the refining chamber 11 through a shaft port 65 provided by the enclosure 60, a packing 67 being maintained under leak-preventing compression about the shaft by means of a pressure ring 68. To provide ample axial adjustment clearance for the rotor 38 relative to the endclosure 60, while avoiding particulate material accumulation, and as narrow as practicable a gap is defined between a diagonal block-off plate ring 69 mounted on the rotor and a spaced confronting diagonal block-off plate ring 70 carried by the closure 60 within the refining chamber 11. Since the chamber area between the plates 69 and 70 is biased toward the outlet 13, constant flushing of the area at the inner end of the rotor 38 prevents material accumulation.

From the foregoing, it will be appreciated that the present invention provides significant improvements over prior refiners, especially for refining low consistency pulp or stock for paper making purposes. Structurally the refining chamber housing 10 and the refining assembly 15 are simple and rugged, and adapted for low cost production and convenient, easy assembly. The refining assembly disks 21 and 22 are easily accessible if necessary, simply by removal of the outer end cover 30 and may be pulled as a unit from the refining chamber 11 by simply removing the closure and retaining plate 51, detaching the rotor 38 from the shaft 39 and pulling out the whole assembly if desired. If it is not desired to remove the whole rotor, the disks 21 and 22 can nevertheless be removed and replaced simply by removing the retaining closure plate 51 after removing the cover 30 and then pulling the disks out one after the other. Mounting of the refining assembly is equally easy.

It will be understood that variations and modifications may be effected without departing from the spirit and scope of the novel concepts of this invention.

We claim as our invention:

1. A refiner construction especially adapted for refining low consistency paper making stock, and comprising:

a frame supporting a housing defining a refining chamber and having a first end closure and an opposite spaced second end closure;

a rotary shaft having an end portion extending through said first end closure and terminating in said chamber;

a rotor mounted on said shaft end portion within said chamber and axially spaced from both of said end closures;

a plurality of radially outwardly extending annular solid refining disks mounted on said rotor and having radially inner margins firmly compacted together in the set;

a complementary set of radially inwardly extending annular solid refining disks supported at their radially outer edges by an annular wall of said housing defining said chamber and having radially outer margins firmly compacted together in the set, and said annular wall being radially spaced from said rotor and said radially outwardly extending disks;

said sets of disks being in partially internested relation, and each disk of one set having a first side surface disposed in spaced relation to a similar first side surface of a contiguous disk of the other set of disks, and the opposite, second side surfaces on said sets of disks being refining surfaces in closely confronting relation;

said closely confronting second side disk refining surfaces defining respective refining zones therebetween closed at the opposite ends of the zones by the compacted together margins of the sets of disks;

flow directing passages provided by the spaces between the first side surfaces of the disks, and said passages effecting communication between the opposite ends of said refining zones so that each refining zone is connected at one radial end with the opposite radial end of the next adjacent refining zone;

means for effecting flow of material to be refined through the portion of said chamber located between said rotor and said second end closure and thereby effecting flow from one end of the refining assembly provided by said disks to the opposite end of the refining assembly and thereby successively through said refining zones and passages and through the portion of said chamber located between the rotor and said first end closure;

and outlet means communicating with said last mentioned portion of the chamber.

2. A refiner according to claim 1, including means for axially adjusting said shaft and said rotor and the disk set thereon and thereby effecting adjustments in the axial relationship of said refining surfaces as permitted by said spaced relationship of the disks of the two sets of disks.

3. A refiner according to claim 1, wherein said second end closure is adapted to be opened for access into said chamber to said refining assembly.

4. A refiner according to claim 1, wherein said passages are oblique and have opposite generally axially extending annular terminal portions communicating with said refining zones and adapted for directing flow of material being refined from the radially outer ends of said refining zones to the radially inner ends of the next adjacent downstream zones.

5. A refiner construction according to claim 1, wherein said rotor comprises a radially extending plate body carrying a cylindrical mounting surface supporting the refining disks mounted on the rotor, and means for securing an axially facing surface of said body to the end of said shaft end portion.

6. A refiner construction according to claim 5, wherein said disk supporting cylindrical mounting surface is on a cylinder which has axially opposite portions thereof extending axially beyond opposite sides of said rotor body, and means for preventing accummulation of material within said extending portions of said cylinder.

7. A refiner construction according to claim 5, wherein said cylinder has a radially outwardly extending shoulder engageable with one end of the set of disks mounted on said cylindrical surface of said cylinder, and means detachably mounted on the opposite end of said cylinder and engaging the opposite end of said set of disks mounted on said cylinder.

8. In a refiner comprising a housing having a refining chamber providing a flow path for particulate material to be refined while travelling between an upstream inlet and a downstream outlet, comprising:

a refining assembly located across said path and having a series of relatively rotatably cooperative axially confronting annular refining surfaces defining radially extending refining zones therebetween, and with radially opposite ends of said zones closed;

said refining surfaces being located on partially internested radially outwardly and radially inwardly extending sets of solid annular refining disks having oblique annular surfaces on sides thereof opposite to the refining surfaces thereon and which oblique annular surfaces cooperate to provide passages serving as means for causing said particulate material to pass successively between the radially outer ends and the radially inner ends of said zones in continuous refining flow from an upstream end to a downstream end of said refining assembly;

one of said sets of disks being fixedly mounted with respect to said housing;

a rotor mounting the other set of disks;

the radially inwardly extending set of disks having radially outer marginal portions which are firmly joined in face-to-face relation, and the radially outwardly extending set of disks having radially inner marginal portions which are firmly joined in face-to-face relation, said thus joined radially outer and radially inner marginal portions providing for the closing of the radially opposite ends of said refining zones.

9. A refiner according to claim 8, wherein said sets of disks have respective cylindrical mounting edges, said rotor having a cylindrical surface engaged by the mounting edges of the set of disks mounted thereon, said housing having a cylindrical surface engaged by the cylindrical mounting edges of the set of disks mounted on the housing, means keying said cylindrical edges of the disks to the cylindrical surfaces engaged thereby, a rotary shaft mounting said rotor, means removeably securing said rotor to said shaft, and means for retaining said sets of disks in stacked interleaved relation, said retaining means being removeable so that by removing said replaceable securing means from the rotor, the rotor can be withdrawn from said housing carrying said sets of disks as a pack assembly.

10. A refiner according to claim 8, including means for effecting relative axial adjustments of said sets of disks and for thereby adjusting the refining surfaces of one set of disks relative to the other set of disks as permitted by spaces between said opposite surfaces.

11. A refiner according to claim 8, wherein said refining surfaces have generally radially extending refining bars which are about 1/16 inch wide by about 1/16 inch high and are spaced apart about 3/16 inch.

12. A refiner for refining solid-containing material for use with a means for charging said material through said refiner under dynamic pressure, said refiner comprising:

a refining chamber;

a rotor extending through said refining chamber;

a first set of refiner disks carried on said rotor;

a second set of refiner disks carried on an interior wall of said refining chamber and intermeshing in alternate fashion with said first set of refiner disks and defining a serpentine path for said material therebetween; and means for disengageably mounting said first and second sets of disks consisting of two series of abutting disengageable elements, one of said series connecting said first set of disks to said rotor and the other of said series connecting said second set of disks to said interior wall in rigid intermeshing relation during operation of said refiner and for permitting removal of the intermeshed first and second sets of refiner disks as a unit upon disengagement of said means.

13. A refiner according to claim 12 further comprising:

a rotor plate mounted at an end of said rotor within said refining chamber and radially projecting from said rotor; and wherein said first series of abutting disengageable elements include a cylinder surrounding and carried by said rotor plate and having an axial surface, a shoulder radially projecting beyond said axial surface at one end of said cylinder, and a retaining plate disengageably connected at an opposite end of said cylinder and having a portion radially projecting beyond said axial surface with said first set of disks mounted and releasably retained on said axial surface between said shoulder and said retaining plate in abutting relation.

14. A refiner according to claim 13 wherein said cylinder has a portion extending axially beyond said rotor plate surrounding and spaced from said rotor, and wherein said refiner further comprises means for avoiding material accumulation within the spaced between said axially projecting portion of said cylinder and said rotor.

15. A refiner according to claim 14, wherein said accumulation avoiding means comprises two spaced diagonal plate rings extending between said axially projecting portion of said cylinder and said rotor defining an annular diagonal channel therebetween.

16. A refiner according to claim 12, wherein said second series of abutting disengageable elements comprises:

an axial interior surface extending annularly around the interior perimeter of said refining chamber;

a retaining ring disposed at one end of said interior axial surface and projecting radially inwardly;

an annular flange disposed at an opposite end of said interior axial surface; and a closure plate disengageably connected to said annular flange with said second set of disks mounted and releasably retained on said interior axial surface between said ring and said closure plate in abutting relation.

17. A refiner according to claim 12 further comprising spaced end closure plates at opposite ends of said chamber, an end portion of said rotor journaled in one of said end closure plates and having a terminal end within said chamber, means securing one side of said rotor plate to said rotor terminal end, said axial surface of said cylinder being in concentric radially spaced relation about said rotor end portion and disposed in axially spaced relation to said end closure plate journalling said rotor portion, said retaining plate at the opposite end of said cylinder disposed in spaced relation to the opposite end closure plate, an inlet for material to be refined extending through said opposite end closure plate coaxially with said rotor, said retaining plate and said opposite end closure plate defining narrow intake flow gap therebetween for leading incoming material to be refined from said inlet toward said sets of disks for refining said material in said serpentine path, and an outlet in said journalling end closure for discharging refined material.

18. A refiner according to claim 12, further comprising reinforcing ribs on said rotor plate and connected to said cylinder.

* * * * *